US005154075A

United States Patent [19]

Hahn et al.

[11] Patent Number: 5,154,075

[45] Date of Patent: Oct. 13, 1992

[54] CAN BODY MAKER WITH MAGNETIC RAM BEARING AND DOMER

[75] Inventors: Roger A. Hahn, Arvada; Phillip W. Gold, Lakewood; Harold Cook, Jr., Evergreen, all of Colo.

[73] Assignee: Coors Brewing Company, Golden, Colo.

[21] Appl. No.: 724,809

[22] Filed: Jul. 2, 1991

Related U.S. Application Data

[63] Continuation-in-part of Ser. No. 578,938, Sep. 7, 1990.

[51] Int. Cl.[5] ..... B21D 22/30

[52] U.S. Cl. ..... 72/348; 72/465

[58] Field of Search ..... 72/347, 348, 349, 430, 72/431, 465; 100/917; 267/130; 310/12, 14

[56] References Cited

U.S. PATENT DOCUMENTS

| | | | |
|---|---|---|---|
| 2,083,168 | 6/1937 | Larson | 72/430 |
| 3,696,657 | 10/1972 | Maytag . | |
| 3,735,629 | 5/1973 | Paramonoff . | |
| 3,877,761 | 4/1975 | Boden et al. . | |
| 3,955,394 | 5/1976 | Kaufman et al. . | |
| 4,141,604 | 2/1979 | Habermann et al. . | |
| 4,173,138 | 11/1979 | Main et al. . | |
| 4,180,296 | 12/1979 | Habermann . | |
| 4,353,602 | 10/1982 | Habermann . | |
| 4,473,259 | 9/1984 | Goldowsky . | |
| 4,504,098 | 3/1985 | Battarel et al. . | |
| 4,578,981 | 4/1986 | Nishikawa et al. . | |
| 4,583,794 | 4/1986 | Takahara et al. . | |
| 4,597,613 | 7/1986 | Sudo . | |
| 4,614,104 | 9/1986 | Straw . | |
| 4,642,500 | 2/1987 | Higuchi et al. . | |
| 4,790,169 | 12/1988 | Johansson et al. . | |
| 4,795,927 | 1/1989 | Morii et al. . | |
| 4,807,459 | 2/1989 | Grims et al. . | |
| 4,827,169 | 5/1989 | Habermann . | |
| 4,841,212 | 6/1989 | Matsushita et al. . | |
| 4,892,328 | 1/1990 | Kurtzman et al. . | |
| 4,912,343 | 3/1990 | Stuart . | |
| 4,934,167 | 6/1990 | Grims et al. . | |

FOREIGN PATENT DOCUMENTS

| | | |
|---|---|---|
| 24842 | 10/1922 | France . |
| 453220 | 12/1974 | U.S.S.R. . |

OTHER PUBLICATIONS

Pamphlet entitled "Linear Induction Motors" of Northern Magnetics, Inc., Van Nuys, CA, pp. 1-6.

Pamphlet by Northern Magnetics, Inc., Van Nuys, CA, pp. 11-13 and 15-17.

Design Bulletin No. 4 of Northern Magnetics, Inc., Van Nuys, CA (Jan. 1978), pp. 1-13 and Tables.

Technical bulletin #769-3 of Northern Magnetics, Inc., Van Nuys, CA.

Article entitled "Linear Induction: A New Way to Go," *Mechanix Illustrated* (Dec. 1975), pp. 38-40.

*Primary Examiner*—Lowell A. Larson

*Attorney, Agent, or Firm*—Klaas, Law, O'Meara & Malkin

[57] ABSTRACT

A can body maker apparatus of the type having an axially reciprocal ram member and an axially reciprocal redraw carriage comprising a ram position sensing assembly for sensing the position of the ram member and for generating a ram position signal in response thereto; an electromagnetic bearing assembly for frictionlessly radially supporting and aligning one end of the ram member with a predetermined ram displacement path; an electromagnetic redraw carriage actuator for applying magnetic force to the redraw carriage for reciprocating the redraw carriage; and a control assembly for selectively energizing and deenergizing electromagnets in the electromagnetic bearing assembly and the electromagnetic redraw assembly in response to the ram position signal, also, an electromagnetic doming apparatus is provided for shaping the bottom portion of the can body.

19 Claims, 8 Drawing Sheets

CAN BODY MAKER WITH MAGNETIC RAM BEARING AND DOMER

This application is a continuation-in-part application of U.S. patent application Ser. No. 578,938 filed Sep. 7, 1990.

FIELD OF THE INVENTION

This invention relates generally to a can body making apparatus and more particularly to a ram assembly, a redraw assembly and a domer assembly thereof.

BACKGROUND OF THE INVENTION

A can body making apparatus is described in U.S. Pat. No. 3,696,657 issued to J. H. Maytag, which is hereby incorporated herein by reference for all that it discloses. The ram carriage and redraw carriage are each mounted on rollers which move over carriage way strips. Each pair of upper and lower rollers are urged toward each other so as to be in firm contact with the carriage way strip located therebetween. Both the ram and redraw carriages are reciprocated at rates sufficient to form about two hundred cans a minute. The constant reciprocal movement of the ram and redraw carriages and the tight engagement of the rollers on the carriage way strips result in wear which causes misalignment of the ram or of the can blanks by the redraw sleeve. It is understood that this misalignment is small, between about 0.005 and 0.010 of an inch, but such misalignment can result in defective cans.

U.S. Pat. No. 4,934,167 of Grims et al., which is hereby incorporated by reference for all that it discloses, describes a can body making apparatus having an elongated ram which is connected to apparatus for producing straight line reciprocating motion and which is supported solely by a liquid bearing during the reciprocation thereof.

The Grims et al. patent also discloses a redraw apparatus for a can body making apparatus wherein the redraw carriage is slidably mounted on a pair of spaced apart support posts for reciprocal movement thereover. The support posts are fixedly mounted on a housing holding can forming and ironing dies.

U.S. Pat. No. 4,790,169 of Johansson et al., which is hereby incorporated herein by reference for all that it discloses, describes apparatus for doming the bottom portion of containers.

Other U.S. patents which also describe body maker apparatus, which are all hereby specifically incorporated by reference for all that they disclose, are as follows: U.S. Pat. No. 4,614,104 of Straw; U.S. Pat. No. 4,578,981 of Nishikawa et al.; U.S. Pat. No. 4,173,138 of Main et al.; U.S. Pat. No. 3,955,394 of Kaufman et al.; and U.S. Pat. No. 3,735,629 of Paramonoff.

In certain fields of technology outside the present field of invention it is known to use magnet assemblies to support a moveable shaft. Magnet assemblies for supporting a moveable shaft are described in the following U.S Patents which are hereby specifically incorporated by reference for all that is disclosed therein: U.S. Pat. No. 4,912,343 of Stuart; U.S. Pat. No. 4,892,328 of Kurtzman et al.; U.S. Pat. No. 4,831,212 of Matsushita et al.; U.S. Pat. No. 4,827,169 of Habermann; U.S. Pat. No. 4,795,927 of Morii et al.; U.S. Pat. No. 4,642,500 of Higuchi et al.; U.S. Pat. No. 4,597,613 of Sudo; U.S. Pat. No. 4,583,794 of Takahara it al.; U.S. Pat. No. 4,504,098 of Battarei et al.; U.S. Pat. No. 4,473,259 of Goldowsky; U.S. Pat. No. 4,353,602 of Habermann; U.S. Pat. No. 4,180,296 of Habermann; U.S. Pat. No. 4,141,604 of Habermann et al.; and U.S. Pat. No. 3,877,761 of Boden et al.

SUMMARY OF THE INVENTION

The present invention is directed to a can body maker which employs electromagnets in both a ram supporting bearing assembly and in a redraw carriage actuator. The electromagnets are energized and deenergized based upon ram position so as to maintain the ram at a radially centered position in a predetermined reciprocation path and so as to actuate the redraw carriage at appropriate times during a ram stoke.

Thus, the invention may comprise a method of maintaining a reciprocating ram of a can body maker apparatus in alignment with a predetermined linear reciprocation axis comprising the steps of: mounting a plurality of separately energizable electromagnets in an annular arrangement about a first predetermined axial portion of said linear reciprocation axis; selectively energizing said electromagnets so as to urge a portion of said ram which is circumscribed by said plurality of electromagnets into coaxial relationship with said reciprocation axis.

The invention may also comprise a method of actuating a redraw carriage which is reciprocally mounted on a can body maker comprising the steps of: mounting a first electromagnet assembly relatively forward of the redraw carriage; mounting a second electromagnet assembly relatively rearward of the redraw carriage; energizing the first electromagnet assembly so as to initiate a forward displacement of the redraw carriage; energizing the second electromagnet assembly so as to initiate a rearward displacement of the redraw carriage.

The invention may also comprise can body making apparatus for forming can blanks into elongated can bodies comprising: a stationary support frame; a housing having forming and ironing dies located therein mounted on said support frame; an elongated ram having a first end portion and a second end portion, said first end portion having a generally cylindrical outer surface for movement into said redraw assembly to contact a can blank in said redraw assembly and to move said can blank out of said redraw assembly and through said forming and ironing dies to form an elongated can body, said first end portion being constructed at least partially from magnetic material; reciprocating drive means for providing reciprocating axial displacement for said elongated ram; connecting means on said ram second end portion for connecting said elongated ram to said reciprocating drive means; and magnetic bearing means mounted on said support frame for radially centering and frictionlessly supporting said ram first end portion during reciprocating axial displacement of said ram.

The invention may also comprise can body making apparatus for forming can blanks into elongated can bodies comprising: a stationary support frame; a housing having forming and ironing dies located therein mounted on said support frame; an elongated ram having a first end portion and a second end portion, said first end portion having a generally cylindrical outer surface for movement into said redraw assembly to contact a can blank in said redraw assembly and to move said can blank out of said redraw assembly and through said forming and ironing dies to form an elongated can body, said first end portion being constructed at least partially from magnetic material-reciprocating drive means for providing reciprocating axial displacement for said elongated ram; connecting means on said ram second end portion for connecting said elongated ram to said reciprocating drive means; and a redraw assembly located adjacent to said housing, wherein said redraw assembly comprises: a redraw sleeve for supporting a can body preform thereon; redraw carriage means for supporting and axially displacing said redraw sleeve relative said elongated ram; first redraw electromagnet means fixedly positioned relative said stationary support frame at a location forward of said redraw carriage means for urging said redraw carriage means forwardly during an energized state thereof; second redraw electromagnet means fixedly positioned relative said stationary support frame at a location rearward of said redraw carriage means for urging said redraw carriage means rearwardly during an energized state thereof.

The invention may also comprise a can body maker apparatus of the type having an axially reciprocal ram member and an axially reciprocal redraw carriage comprising: ram position sensing means for sensing the position of said ram member and for generating a ram position signal in response thereto; electromagnetic bearing means for frictionlessly radially supporting and aligning one end of said ram member with a predetermined ram displacement path; electromagnetic redraw carriage actuator means for applying magnetic force to said redraw carriage means for reciprocating said redraw carriage means; control means for selectively energizing and deenergizing electromagnets in said electromagnetic bearing means and said electromagnetic redraw means in response to said ram position signal.

The invention may also comprise doming apparatus for forming the bottom profile of the can body using permanent magnets and electromagnetic coils for providing forces yieldingly resisting the movement of portions of the doming apparatus by forces applied to the can body by the ram member.

BRIEF DESCRIPTION OF THE DRAWINGS

An illustrative and presently preferred embodiment of the invention is shown in the accompanying drawings in which.

DETAILED DESCRIPTION OF THE INVENTION

In General

Figure 1:
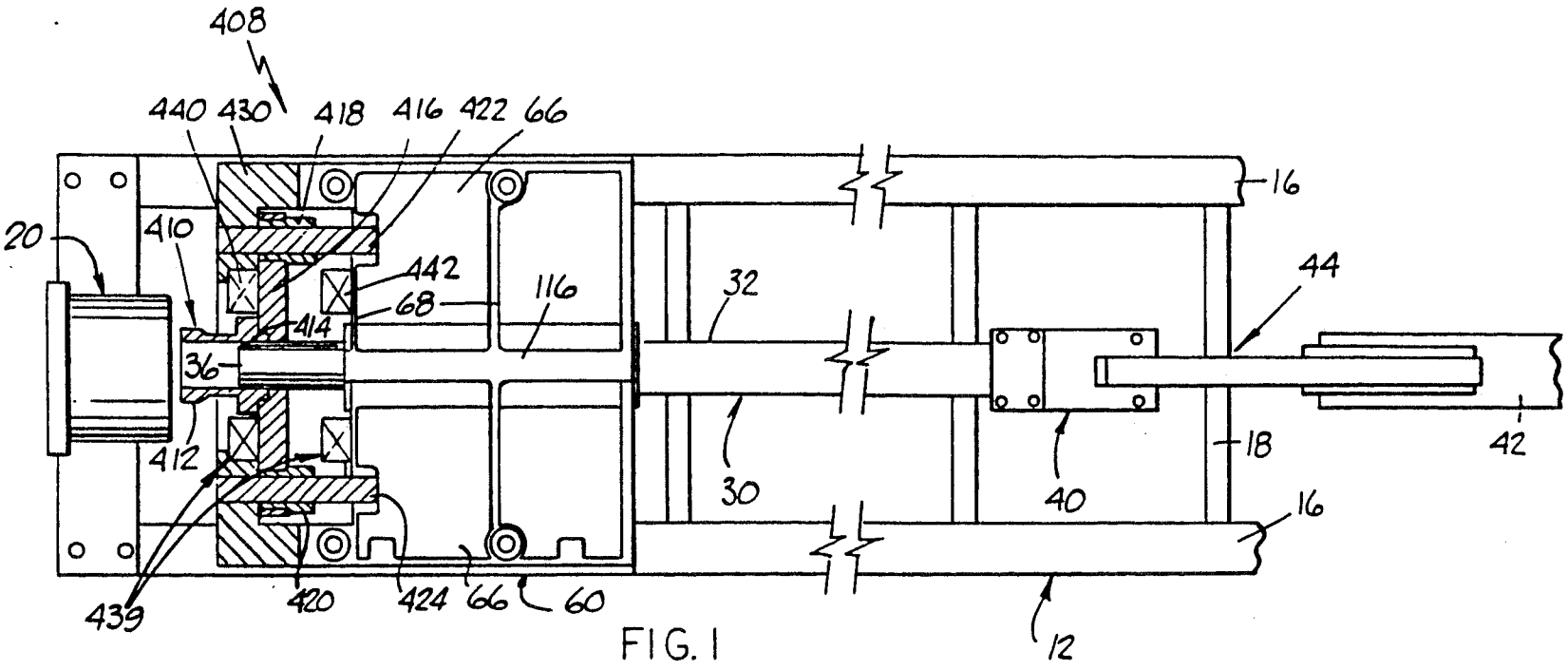
FIG. 1 is a partially cross sectional, top plan view of a can body maker apparatus.
Figure 2:
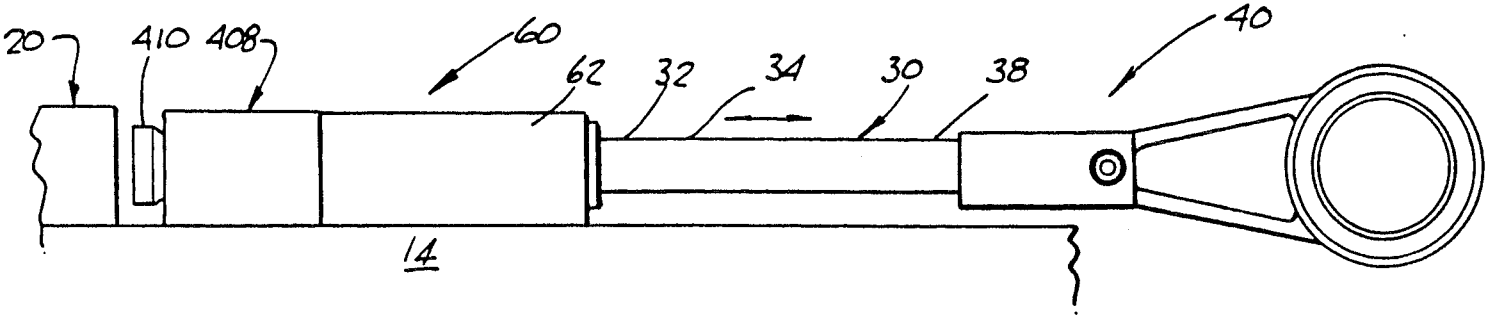
FIG. 2 is a side elevation view of the can body maker apparatus of FIG. 1.

FIG. 1 illustrates a can body maker apparatus 10 of the type having an axially reciprocal ram member 30 and a coaxially aligned redraw assembly 408 which is reciprocally displaceable independently of the ram member 30. A ram position sensing assembly 50, 148, 150, 248, 250, FIG. 4, senses the position of the ram member and generates a ram position signal in response thereto. An electromagnetic bearing assembly 60 frictionlessly radially supports and aligns the ram member with a predetermined ram displacement path RR. A redraw carriage actuator 439 applies magnetic force to a redraw carriage 416 which produces the reciprocal motion of the redraw assembly. A control unit 130 generates data signals for selectively energizing and deenergizing electromagnets in the electromagnetic bearing assembly 60 and the redraw carriage actuator 439 in response to the ram position signal.

Ram Assembly

As illustrated in FIG. 1, can body maker 10 comprises a support frame 12 comprising a pair of spaced apart linearly extending support beams 16 in parallel relationship and having support legs (not shown) fixedly mounted on a floating support base 12 as is conventional in the art. A plurality of cross-beam members 18 extend between and are connected to the support beams 16 to provide a rigid support structure A housing 20 having conventional can forming and ironing dies located therein is fixedly mounted on the support beams 16 by suitable means such as nuts and bolts.

An elongated ram 30 is provided and has a main body portion 32 having a generally cylindrical outer peripheral surface 34 and which is constructed from a magnetic material such as steel. The elongated ram 32 has a first end portion 36 for movement into a redraw assembly to contact a can blank (not shown) located therein and to move the can blank through conventional can forming and ironing dies (not shown) in the housing 20 to form an elongated can body (not shown). The elongated ram 30 has a second end portion 38 which is securely mounted in a connecting device 40.

Apparatus 42 extends from machinery, such as the straight line motion assembly described in detail in the above referenced Maytag and Grims et al. patents, which provides the apparatus 42 with a reciprocating linear motion. A connecting arm 44 is connected to the apparatus 42 and the connecting device 4 to transmit the reciprocating linear motion to the connecting device 40 and the elongated ram 30. Apparatus 42 receives motive force from a crankshaft 46, FIG. 4, which is connected by conventional mechanical linkage to an electric drive motor 48. An electronic encoder unit 50 is mounted on the crankshaft 46 and generates a pulse signal which is representative of crankshaft angular position. In one preferred embodiment an encoder is selected which generates 10,000 pulses per crankshaft revolution. The encoder may be either an incremental, absolute, or linear position indicator type as are commercially available in the industry. The encoder pulse signal is provided to a data processing device having a pulse counter which resets at the beginning of each new crankshaft revolution. The ram performs one ram stroke per crankshaft revolution. The encoder pulse count is thus representative of ram axial position.

A magnetic bearing assembly 60 is mounted in a support structure 62 which is mounted on the support beams 16 so as to hold the magnetic bearing assembly 60 at a fixed location. The magnetic bearing assembly 60, described in more detail below, has a generally cylindrical inner surface 64, FIG. 3, having a diameter slightly greater than the diameter of the generally cylindrical outer surface 34 to provide for sliding movement of the ram main body portion 32 through the magnetic bearing assembly. The difference in diameters between the generally cylindrical outer surface 34 and the generally cylindrical inner surface 64 is between about 0.005 and 0.015 inches. The elongated ram 30 during the reciprocation thereof is frictionlessly supported solely by the magnetic force provided by the magnetic bearing assembly 60.

Figure 3:
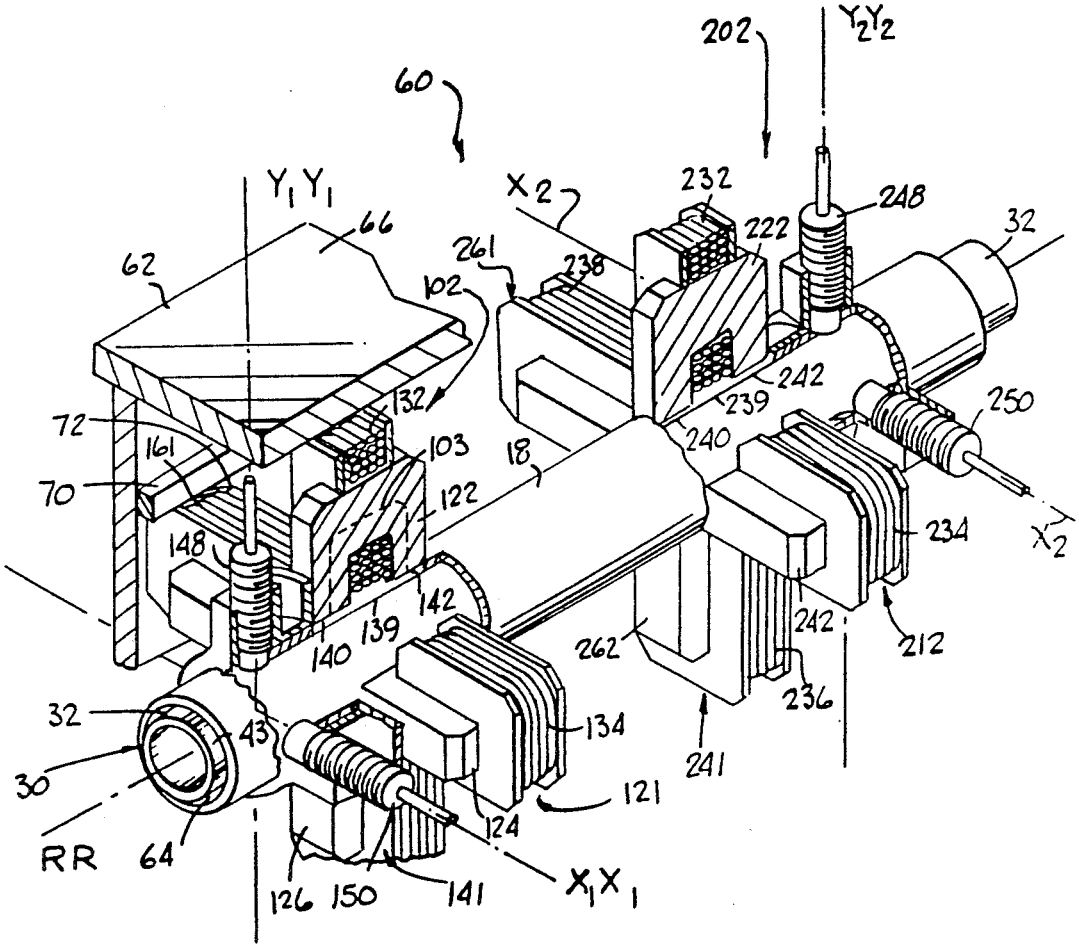
FIG. 3 is a perspective view of a ram magnetic bearing assembly.

The magnetic bearing support housing 62 is illustrated in FIGS. 1 and 3. The support housing 62 comprises an integral casting preferably formed from nonmagnetic material such as cast aluminum and has a pair of linearly extending beams 66 each having a generally planar bottom surface. Beams 66 abut and are attached to beams 16 of support frame 12. A plurality of reinforcing ribs 68 extend between and are integral with beams 66 An interior wall 70 of support housing 62 comprises a plurality of flange portions 72, etc., projecting therefrom which are adapted to be fixedly secured, as by attachment bolts, to various portions of the bearing assembly 60.

Magnetic bearing assembly 60 for frictionlessly supporting ram 30 main body portion 32 is illustrated in FIG. 3. The magnetic bearing assembly includes an elongated cylindrical sleeve 118 which comprises inner surface 64. A forward and a rear magnetic bearing, 102, 202 are provided by two sets of U-shaped stationary electromagnets 110, 112, 114, 116 and 210, 220, 224, 226 and position sensors 148, 150, and 248, 250 respectively are located at each end of sleeve 118 which ma be 15 inches long.

Each set of electromagnets preferably consists of four electromagnets, e.g. 110, 112, 114, 116, located 90 degrees apart around the periphery of the sleeve 118 and are operable to generate four orthogonal magnetic fields 130 within the sleeve 118.

Each set of positions sensors, e.g. 148, 150, are aligned with associated electromagnets, e.g. 110, 112, to define two orthogonal horizontal $X_1X_1$, $X_2X_2$ and vertical $Y_1Y_1$, $Y_2Y_2$ axes from which signals proportional to orthogonal ram shaft displacement are provided. These signals are provided to a data processing unit 130, FIG. 4, which also receives the pulse signal from encoder 50.

Figure 4:
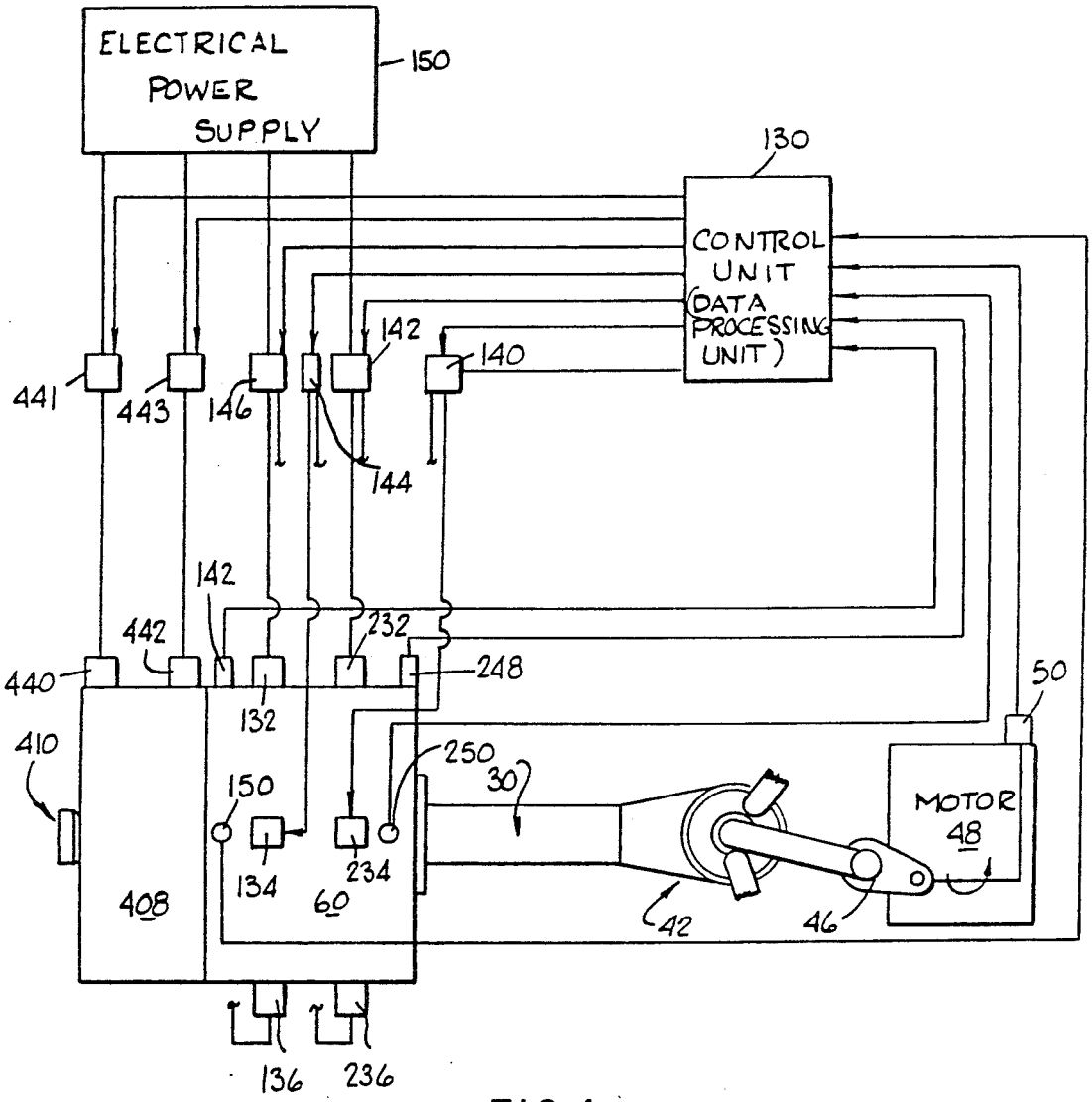
FIG. 4 is a schematic illustration of a control system for the ram and redraw assembly of the body maker apparatus of FIG. 1.

The data processing unit 130 issues control signals to control circuits 142, 144, 144, 146, FIG. 4, which controls the current flow from electric energy source 150 to each opposed set of electromagnets so as to energize the coil windings 132, 134, 136, 138 and 232, 234, 236, 238 for radially centering the elongated ram 30 within the sleeve 118. The electromagnets may be energized either in a linear fashion or in a pulsed manner as is well known in the art. In the preferred embodiment, pulsed energization is employed.

In one embodiment of the invention the data processing unit 130 generates control signals based solely on ram radial position as sensed by sensors 148, 150, 248, 250. The data processing unit in this embodiment may comprise hard wired electronic components identical to those described in U.S. Pat. No. 4,473,259 of Goldowsky.

In a preferred embodiment of the invention which is presently the best mode contemplated, data processing unit 130 generates control signals based upon both ram radial position as sensed by sensors 148, 150, 248, 250 and is also based upon ram axial position as indicated by encoder 50.

Figure 5:
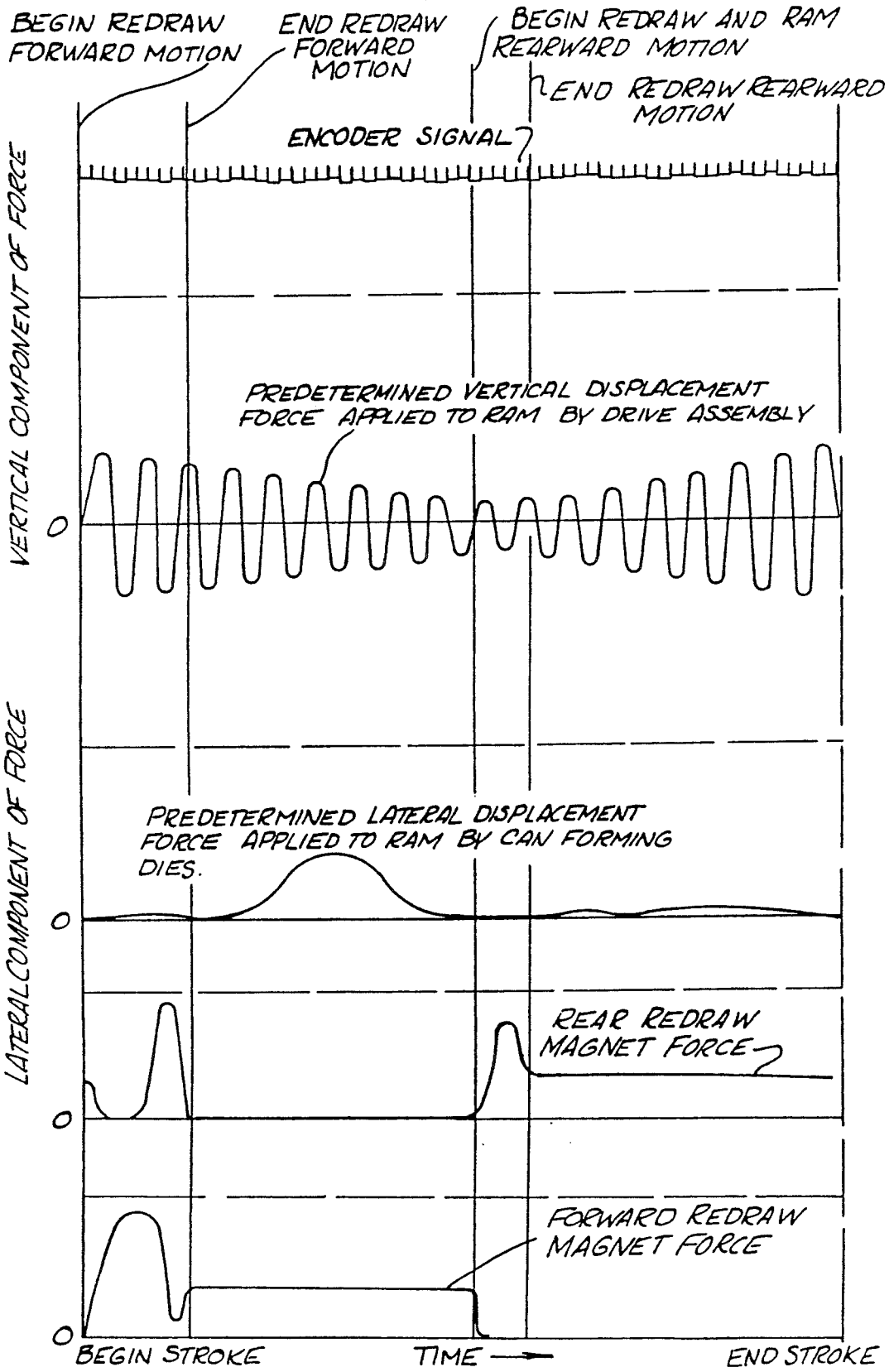
FIG. 5 is a graph illustrating typical vertical and lateral forces exerted on a bearing assembly by a ram.

As indicated in FIG. 5, encoder signal 300 comprises a set of signal pulses 302, 304, etc., which are indicative of the exact axial position of the ram 30 at any point in time. FIG. 5, also shows a force signal 310 which is typical of the total vertical force applied to a magnetic bearing e.g. 202 during a ram operating stroke. Forces which contribute to this total vertical force include a sinusoidal force applied by the ram drive apparatus 42 due to the fact that the linear motion assembly always has a small component of nonlinear force on apparatus 42. This force and also the force attributable to the weight of the ram 30 itself vary in magnitude during the ram stroke due to the changing length of the moment arm associated with each of these forces during a ram stoke. However, these components of the total vertical force exerted on the magnetic bearing are cyclical and under normal operating conditions represent substantially all of the vertical force which will be exerted on the magnetic bearing. This force may be empirically determined using conventional strain gages and/or other means and may be stored as a function of ram axial position in a conventional electronic storage medium such as the RAM of a conventional microcomputer which may comprise a portion of the data processing unit 50.

FIG. 5 further illustrates at 350 the total lateral side loading force which may typically be exerted on electromagnet bearing 202 by ram 30. The short interval large magnitude force indicated at 352 is primarily due to a side force experienced at the end of ram 30 as it moves through the can forming dies. This relatively large magnitude force is cyclical and, like the cyclical vertical force, may also be empirically determined and stored as a function of ram axial position.

There are various forms in which the data represented by curves 310 and 350 may be stored which enables the force value associated with a particular ram position to be readily determined, e.g. in computer look up table form or as a mathematical formula derived by conventional curve matching techniques. As used herein the process of obtaining a force value from this predetermined correlated and stored information representative of ram axial position and associated force will be referred to as "applying a predetermined algorithm" to the ram axial position value regardless cf whether the data is stored as a mathematical equation, in a look up table or in any other readily retrievable form.

Since the solid lines 310 350 represent the force applied to a magnetic bearing by the ram during a normal ram stroke it will of course be necessary for the bearing assembly to apply an identical amount of force to the ram 30 at the corresponding axial positions in order to maintain the ram in a centered position in the bearing. Accordingly in one preferred embodiment of the invention the data processing means, which may comprise a conventional microprocessor, at predetermined intervals, e.g. every 5 milliseconds, reads the encoder count and applies a predetermined algorithm thereto based upon the empirically determined force relationship e.g. 310 in order to determine the force to be applied and then provides a control signal to the control circuitry for the associated opposed pairs of magnets e.g. 232, 236, which causes the magnets to apply the determined force to the ram. It will of course be appreciated that in implementing this method of control a separate force/axial position algorithm is determined and stored for use in association with each opposed pair of electromagnets.

In addition to determining a first (primary) force signal based for each opposed pair of electromagnets based upon a stored axial position/force algorithm as described above, the data processing unit 130 may also determine a second (secondary) force signal based upon the radial position of the portions of the ram 30 sensed by sensors 148, 150 and 248, 250. Thus in addition to the primary force signal provided for each opposed magnet pair a secondary signal is also generated for each magnet pair which is added to the primary signal to provide a resultant signal which is used to determine the force applied by the magnet pair. This secondary signal may be generated in a manner identical to that described in the Goldowsky patent. Alternatively, this secondary force signal may be generated through the use of a predetermined algorithm which is stored in computer software and which is applied to the raw sensor signal generated by an associated radial position sensor.

As a further means of control data representative of the each radial position sensor signal value as a function of ram axial position is accumulated and stored for at least one and preferably about 20 previous ram stokes. This stored data is then processed and used to adjust the predetermined algorithm, e.g. 310, which is used to determine the primary force signal which is applied by an opposed magnet pair to the ram 30. Using this further means of control the primary control algorithm may be periodically modified to account for changing conditions, such as heating and cooling of machine components, which may effect the force which must be exerted on the ram to maintain it in a centered position during all phases of the stroke. Using this further means of control it may be possible to determine the primary control algorithm e.g. 310 for each opposed set of electromagnets, e.g. 232, 236, by starting with a straight line primary algorithm and simply running the apparatus. During initial stages of operation most of the control would be provided by the secondary control signal. As the number of operating cycles progress the primary control algorithm, through periodic adjustment would become more and more representative of the actual total control force required and would thus require progressively less adjustment by the secondary control force signal.

Figure 6:
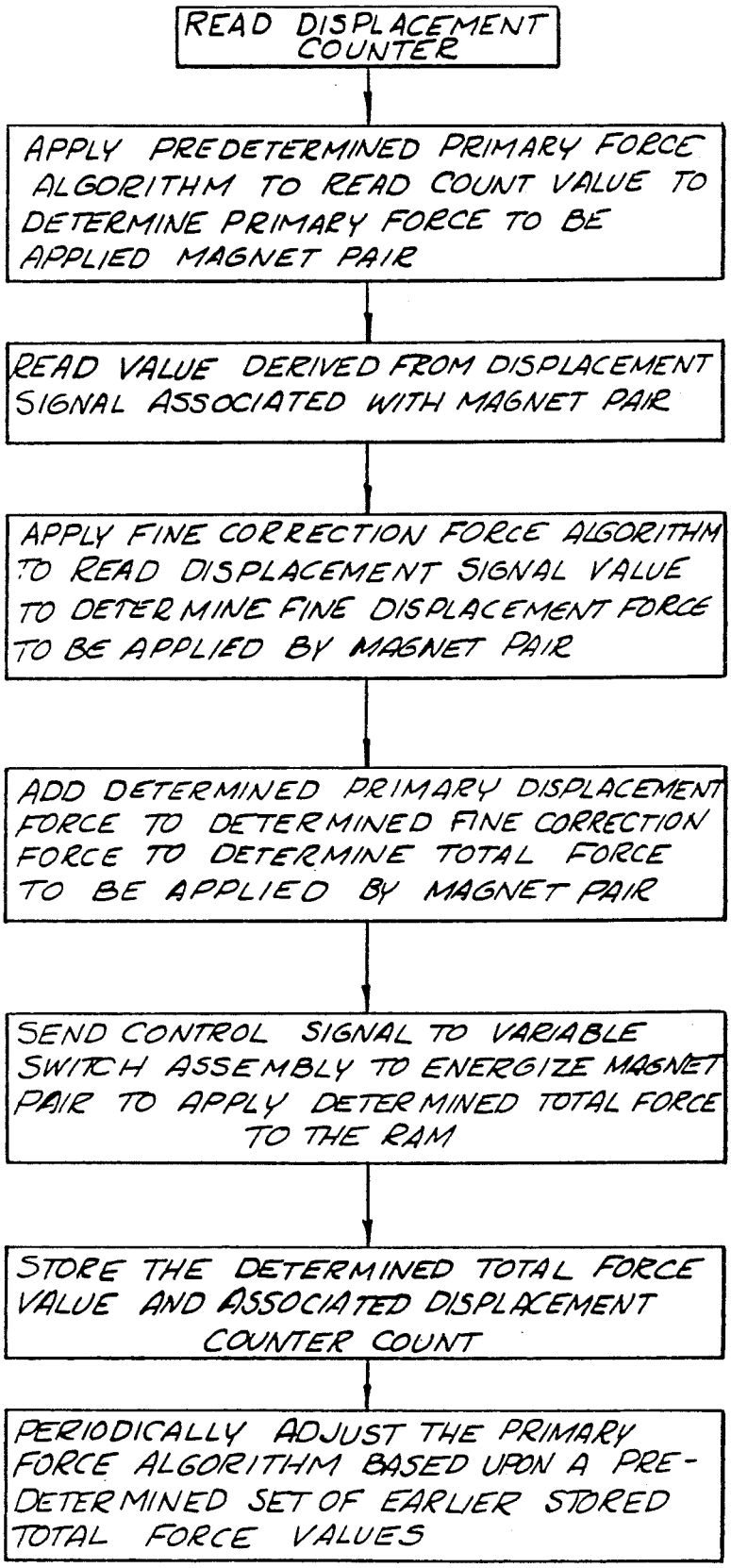
FIG. 6 is a block diagram illustrating the operation of a portion of the control system of FIG. 4.

The above described control method which provides a total control force signal based upon a primary force signal and a modifying secondary force signal and wherein an algorithm used to generate the primary force signal is periodically modified based upon a ram radial displacement signal is illustrated in block diagram form in FIG. 6. It will of course be understood that the method illustrated in FIG. 6 is described for a single pair of opposed electromagnets and that an identical process will be performed for each of the opposed pair of magnets at each sampling interval of the data processing means.

Redraw Assembly

As best illustrated in FIG. 1 redraw assembly 408 comprises a redraw sleeve 410 which is coaxial with ram displacement axis RR. Redraw sleeve 410 has a central cylindrical cavity extending therethrough which is adapted to slidingly receive ram member 30 therethrough. The general sequence of reciprocal motion of redraw sleeve with respect to the motion of ram 30 is as described in the above referenced Maytag patent.

The redraw sleeve 410 comprises a forward end 410 which is adapted to receive a can body preform known as a cup (not shown) thereon. The redraw sleeve comprises a rear end 414 which is fixedly secured to a redraw carriage 416.

The redraw carriage has a first and second bushing 416, 418 mounted therein which are adapted to slide on post members 422, 424. The post members have rear end portions which are fixedly mounted on a forward portion of ram bearing housing 62 and which have forward end portions which are fixedly mounted on redraw support bracket 430 which is itself attached to the ram housing 62.

A redraw actuator assembly 439 is fixedly supported by the support bracket 430. The actuator assembly comprises a forward ring shaped electromagnet 440 positioned forwardly of the redraw carriage and defining the forwardmost travel position of the redraw carriage. The actuator assembly also comprises a rear ring shaped electromagnet 442 positioned rearwardly of the redraw carriage and defining the rearwardmost travel position of the redraw carriage.

Figure 7:
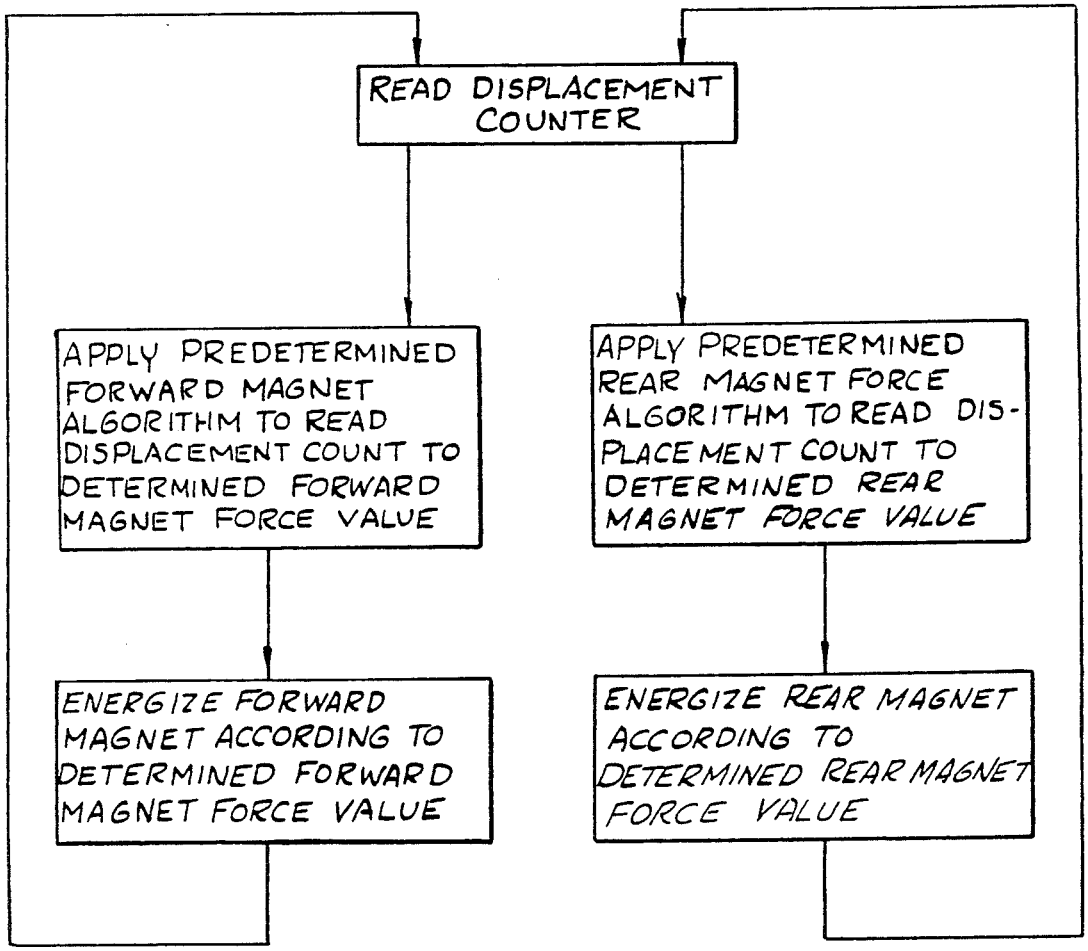
FIG. 7 is a block diagram illustrating the operation of another portion of the control system of FIG. 4.

As illustrated in FIG. 4, the forward and rear redraw magnets 440, 442 are energized and deenergized in response to control signals generated by data processing unit 130. As shown by FIG. 4 and the block diagram of FIG. 7, the data processing means generates control signals which are sent to control circuits 441, 443 to energize or deenergize electromagnets 440, 442. The control signals are generated in response to ram 30 position as determined by the pulse signal from encoder 50. The control signal for each electromagnet 440, 442 is generated by applying a predetermined algorithm to the ram position signal. The algorithm which is applied may be determined analytically or empirically. The resulting force applied by each of the electromagnets causes the redraw carriage to begin moving forwardly at the beginning of each ram stoke. The forward movement of the redraw carriage is sufficiently fast such that the cup carried by the redraw sleeve is moved into engaged position with the tool pack housing 20 prior to the arrival of the ram 3C. However the redraw carriage must decelerate sufficiently prior to housing 20 engagement such that there is relatively little rebound at engagement. FIG. 5, illustrates a typical force profile for obtaining such a result. The electromagnets are energized and deenergized in a similar manner to return the redraw carriage to its rearmost position at approximately the same time that the ram 30 begins its rearward travel.

Domer Assembly

Figure 8:
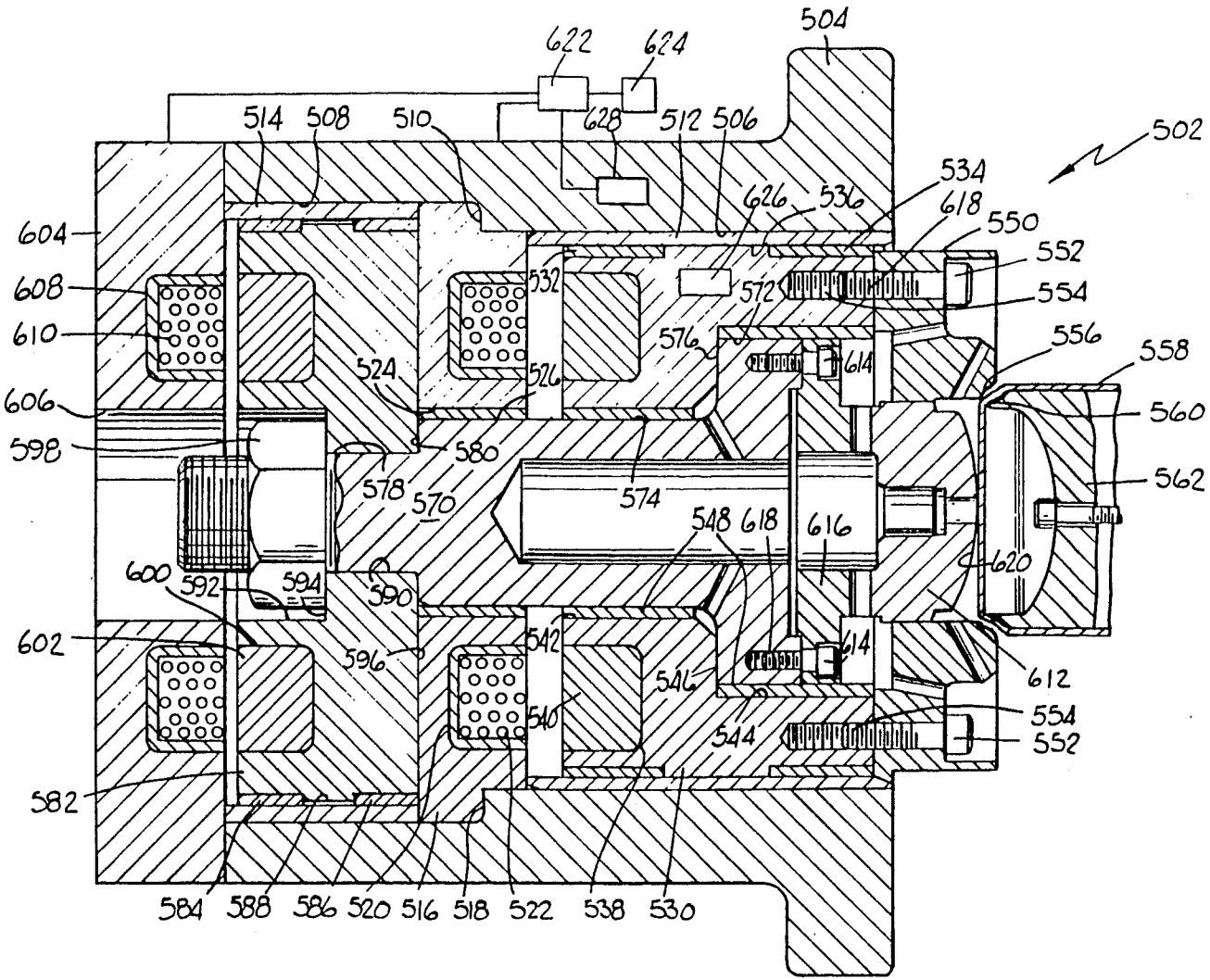
FIG. 8 is a side elevational view with parts in section of a doming apparatus in a non-doming location.
Figure 9:
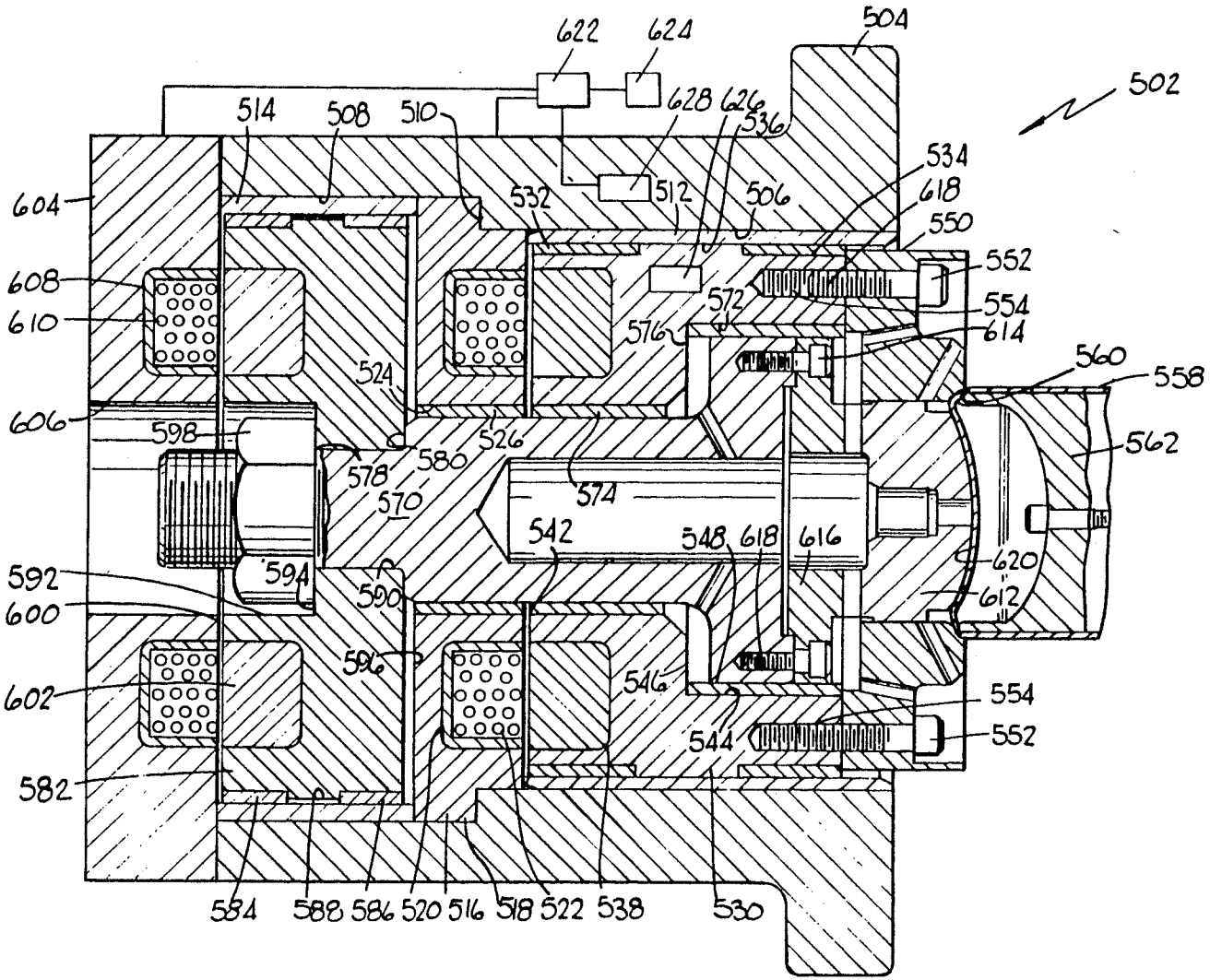
FIG. 9 is a view similar to FIG. 8 with the doming apparatus in a doming location.

A preferred embodiment of doming apparatus 502 is illustrated in FIGS. 8 and 9. A housing 504 is mounted at a fixed location on support means, such as the stationary support means 12. The housing 504 has a first generally cylindrical inner surface 506 and a second generally cylindrical inner surface 508 having a diameter greater than the diameter of the first generally cylindrical inner surface 504 so as to form an abutment shoulder 510 therebetween. A generally cylindrical bushing 512 is mounted on a portion of the first generally cylindrical inner surface 506 and a generally cylindrical bushing 514 is mounted on a portion of the second generally cylindrical inner surface 508. A first member 516 is mounted at a fixed location in the housing 504 and has an abutment shoulder 518 in contact with the abutment shoulder 510. The first member 516 has an annular recess 520 formed therein and its opening faces in an axial direction. An annular electromagnetic coil 522 is mounted in the annular recess 520. The first member 516 has a generally cylindrical inner surface 524 and has a cylindrical bushing 526 mounted thereon.

A second member 530 is mounted for reciprocal sliding movement over the first generally cylindrical bushing 512. The second member 530 has a pair of spaced apart generally cylindrical bushings 532 and 534 mounted in recesses in the generally cylindrical outer surface 536 thereof. An annular recess 538 is formed in the second member 530 and its opening faces the electromagnetic coil 522. An annular permanent magnet 540 is mounted in the annular recess 538. The magnetic field of the permanent magnet 540 has a predetermined polarity and a direct current is passed through the electromagnetic coil 522 so as to produce a magnetic field having the same polarity so that a repelling force exists between the permanent magnet 540 and the electromagnetic coil 522 when it is energized. Although it is preferred to have one annular recess 50 and one annular electromagnetic coil 522, there could be a plurality of recesses formed in the first member 516 with an electromagnetic coil in each recess. Also, the second member 530 could have a plurality of recesses formed therein with a permanent magnet in each recess. The second member 530 has a first generally cylindrical inner surface 542 and a second generally cylindrical inner surface 544 having a diameter greater than the diameter of the first generally cylindrical inner surface 542 sc as to form an abutment shoulder 546 therebetween. Generally cylindrical bushings 548 are mounted on the first and second generally cylindrical inner surfaces 542 and 544.

An annular pressure ring 550 is secured to the second member 530 by a plurality of headed threaded bolts 552 in threaded engagement with threaded openings 554. The annular pressure ring 550 has an annular surface 556 located to be contacted by the can body 558 and to cooperate with an annular surface 560 on the punch 562 to form a portion of the bottom portion of the can body 558.

A third member 570 is mounted for reciprocal sliding movement over the generally cylindrical bushings 526 and 548. The third member 570 has a first generally cylindrical outer surface 572 and a second generally cylindrical outer surface 574 having a diameter less than the diameter of the first generally cylindrical outer surface 572 so as to form an abutment shoulder 576 therebetween and a third generally cylindrical, externally threaded outer surface 578 having a diameter less than the diameter of the second generally cylindrical outer surface 574 so as to form an abutment shoulder 580 therebetween A fourth member 582 is mounted for reciprocal sliding movement over the generally cylindrical bushing 514. The fourth member 582 has a pair of spaced apart generally cylindrical bushings 584 and 586 mounted in recesses in the generally cylindrical outer surface 588 thereof.

The fourth member 582 has a first generally cylindrical inner surface 590 having a diameter substantially the same as the diameter of the third generally cylindrical outer surface 578 so that it can be mounted thereon and a second generally cylindrical inner surface 592 having a diameter less than the diameter of the first generally cylindrical inner surface 590 so as to form an abutment shoulder 594 thereon. The fourth member 582 has a generally planar radially extending surface 596. The fourth member 582 is mounted on the third member 570 for movement therewith using a threaded nut 598 in threaded engagement with the externally threaded outer surface 578 to apply forces against the abutment shoulder 594 to move the radially extending surface 596 into engagement with the abutment shoulder 580. The fourth member 582 has an annular recess 600 forced therein and its opening faces in an axial direction. An annular permanent magnet 602 is mounted in the annular recess 600.

An annular back plate 604 is mounted at a fixed location on the housing 504 and has a generally cylindrical inner surface 606 having a diameter substantially equal to the diameter of the generally cylindrical inner surface 592 to permit access to the threaded nut 598. The annular back plate 604 has an annular recess 608 formed therein and its opening faces the annular permanent magnet 602. An annular electromagnetic coil 616 is mounted in the annular recess. The magnetic field of the annular permanent magnet 602 has a predetermined polarity and a direct current is passed through the electromagnetic coil 610 so as to produce a magnetic field having the same polarity so that a repelling force exists between the permanent magnet 602 and the electromagnetic coil 610 when it is energized. As described above, the annular recess 600 could comprise a plurality of recesses each having a permanent magnet mounted therein and the annular recess 608 could comprise a plurality of recesses each having an electromagnetic coil mounted therein. Also, if desired, the permanent magnet or magnets could be an electromagnetic coil or coils.

A doming die 612 is mounted on the third member 570 using threaded headed bolts 614 passing through openings in a flange portion 616 and in threaded engagement with threaded openings 618 in the third member 570. The doming die 612 has an dome shaped surface 620 for forming a dome shape in the bottom of the can body 558.

In operation, a sensor (not shown) in the punch 562 will activate a sensor (not shown) in the forming and ironing die housing 20 which sends a signal to electrical control means 622 connected to an electric direct current source 624 to transmit an electric direct current to energize the electromagnetic coils 522 and 610 and produce the repelling forces between the electromagnetic coil 522 and the permanent magnet 540 and between the electromagnetic coil 610 and the permanent magnet 602. As illustrated in FIG. 1, a portion of the can body 558 has moved into contact with the arcuate surface 556. The continued movement of the can body 558 moves the second member 530 which movement is yieldingly resisted by the repelling force between the electromagnetic coil 522 and the permanent magnet 540. Since it is desirable to maintain the yieldingly resistant force substantially constant, a sensor 626 in the second member 530 cooperates with a sensor 628 in the housing 504 to send a signal to the electrical control means 622 to vary the voltage of the direct current to the electromagnetic coil 522. The continued movement of the can body 558 moves it into contact with the dome shaped surface 620 and moves the third member 570 which movement is yieldingly resisted by the repelling force between the electromagnetic coil 610 and the permanent magnet 602 and which repelling force is greater than the repelling force between the electromagnetic coil 522 and the permanent magnet 540 so that the second member 530 moves at a velocity greater than the velocity of the third member 570. As illustrated in FIGS. 8 and 9, the second member 530 moves through a distance that is three times greater than the distance through which the third member 570 moves. As illustrated in FIG. 9, the movement of the can body 558 stops before there is contact between the electromagnetic coil 522 and the permanent magnet 540 and between the electromagnetic coil 610 and the permanent magnet 602. Under some doming operations, it is not necessary for the doming means to move so that there would be no need for the movable third member 570, the electromagnetic coil 610 and the permanent magnet 602.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A method of yieldingly resisting axial movement of at least a portion of a doming apparatus in response to forces applied thereto by a can body on a reciprocating ram of a can body making apparatus wherein the doming apparatus has a fixed member and a movable member comprising:

mounting electromagnetic coil means in one of said fixed and movable members for providing a magnetic field;

mounting permanent magnet means for providing a magnetic field of predetermined polarity in the other of said fixed and movable members and facing said electromagnetic coil means;

said fixed member and said movable member having coinciding longitudinal axes;

moving said can body against said movable member to apply a moving force thereto; and energizing said electromagnetic coil by passing a direct current therethrough to provide a magnetic pole having a polarity similar to the pole polarity in said permanent magnet means to provide a repelling force to yieldingly resist the movement of said movable member in response to the forces applied by said can body.

2. The method as in claim 1 and further comprising:

varying the voltage of said DC current as said movable member approaches said fixed member.

3. The method as in claim 1 and further comprising:

sensing the axial position of said movable member and generating a signal indicative thereof; and energizing said electromagnetic in response to the position of said movable member.

4. The method as in claim 1 and further comprising:

forming a continuous annular magnetic field by said permanent magnet means; and forming a continuous annular magnetic field by said electromagnetic coil means.

5. Can body making apparatus for forming can blanks into elongated can bodies comprising:

a stationary support frame;

a redraw assembly for providing can blanks;

a housing having forming and ironing dies located therein mounted on said support frame;

doming apparatus for doming the bottom of the can body;

an elongated ram having a first end portion and a second end portion, said first end portion having a generally cylindrical outer surface for movement into said redraw assembly to contact a can blank in said redraw assembly and to move said can blank out of said redraw assembly and through said forming and ironing dies and into said doming apparatus to form an elongated can body, said first end portion being constructed at least partially from magnetic material;

reciprocating drive means for providing reciprocating axial displacement for said elongated ram;

connecting means on said ram second end portion for connecting said elongated ram to said reciprocating drive means;

magnetic bearing means mounted on said support frame for radially centering and frictionlessly supporting at least said ram first end portion during reciprocating axial displacement of said elongated ram; wherein said doming apparatus comprises:

a housing having a longitudinal axis;

a first member fixedly mounted in said housing;

a second member mounted for reciprocal sliding movement in said housing;

a doming die mounted in said housing;

first electromagnetic coil means for providing a magnetic field mounted in one of said first and second members;

first permanent magnet means for providing a magnetic field of predetermined polarity mounted in the other of said first and second members;

said reciprocating ram moving said can body against said second member to apply forces on said second member tending to move said second member; and energizing means for energizing said first electromagnetic coil means to produce a magnetic field having a polarity similar to said predetermined polarity to provide a repelling force to yieldingly resist the movement of said second member in response to said forces applied by said can body.

6. The invention as in claim 5 wherein:

said magnetic field of predetermined polarity having an annular shape having a longitudinal axis coinciding with said longitudinal axis of said housing; and said magnetic field of similar polarity having an annular shape having a longitudinal axis coinciding with said longitudinal axis of said housing.

7. The invention as in claim 6 wherein:

said first permanent magnet means comprises one annular permanent magnet having a longitudinal axis coinciding with said longitudinal axis of said housing; and said first electromagnetic coil means comprises one annular electromagnetic coil having a longitudinal axis coinciding with said longitudinal axis of said housing.

8. The invention as in claim 5 wherein:

said energizing means comprises electrical means for passing a direct current through said first electromagnetic coil means.

9. The invention as in claim 8 and further comprising:

sensor means in said second member and said housing for sensing the axial position of said second member and generating a signal indicative thereof; and electrical control means for receiving said signal to vary the voltage of said direct current passing through said first electromagnetic coil means.

10. The invention as in claim 5 and further comprising:

said first member having a passageway extending therethrough and having a generally cylindrical inner surface;

said second member having a passageway extending therethrough and having a generally cylindrical inner surface;

said doming die having a generally cylindrical outer surface and being mounted in said passageways of said first and second members for limited reciprocal sliding movement;

a third member fixedly mounted in said housing;

a fourth member mounted for reciprocal sliding movement in said housing;

said doming die mounted on said fourth member for movement therewith;

second electromagnetic coil means for providing a magnetic field mounted in one of said third and fourth members;

second permanent magnet means for providing a magnetic field of predetermined polarity mounted in the other of said third and fourth member;

said reciprocating ram moving said can body against said doming die to apply forces on said doming die tending to move said fourth member; and energizing means for energizing said second electromagnetic coil means to produce a magnetic field having a polarity similar to said predetermined polarity to provide a repelling force to yieldingly resist the movement of said fourth member in response to said forces applied by said can body.

11. The invention as in claim 10 wherein:

said magnetic field of predetermined polarity in said other of said third and fourth members having an annular shape having a longitudinal axis coinciding with said longitudinal axis of said housing; and said magnetic field in said one of said third and fourth members of similar polarity having an annular shape having a longitudinal axis coinciding with said longitudinal axis of said housing.

12. The invention as in claim 10 wherein:

said second permanent magnet means comprises one annular permanent magnet having a longitudinal axis coinciding with said longitudinal axis of said housing; and said second electromagnetic coil means comprises one annular electromagnetic coil having a longitudinal axis coinciding with said longitudinal axis of said housing.

13. The invention as in claim 10 wherein:

said first electromagnetic coil mean is in said first member;

said first permanent magnet means is in said second member;

said second electromagnetic means is in said third member; and said second permanent magnet means is in said fourth member.

14. Doming apparatus for a can body making apparatus for forming can blanks into elongated can bodies comprising:

a housing having a longitudinal axis;

a first member fixedly mounted in said housing;

a second member mounted for reciprocal sliding movement in said housing;

a doming die mounted in said housing;

first electromagnetic coil means for providing a magnetic field mounted in one of said first and second members;

first permanent magnet means for providing a magnetic field of predetermined polarity mounted in the other of said first and second members;

said reciprocating ram moving said can body against said second member to apply forces on said second member tending to move said second member; and energizing means for energizing said first electromagnetic coil means to produce a magnetic field having a polarity similar to said predetermined polarity to provide a repelling force to yieldingly resist the movement of said second member in response to said forces applied by said can body.

15. The invention as in claim 14 wherein:

said magnetic field of predetermined polarity having an annular shape having a longitudinal axis coinciding with said longitudinal axis of said housing; and said magnetic field of similar polarity having an annular shape having a longitudinal axis coinciding with said longitudinal axis of said housing.

16. The invention as in claim 14 wherein:

said first permanent magnet means comprises one annular permanent magnet having a longitudinal axis coinciding with said longitudinal axis of said housing; and said first electromagnetic coil means comprises one annular electromagnetic coil having a longitudinal axis coinciding with said longitudinal axis of said housing.

17. The invention as in claim 14 and further comprising:

said first member having a passageway extending therethrough and having a generally cylindrical inner surface;

said second member having a passageway extending therethrough and having a generally cylindrical inner surface;

said doming die having a generally cylindrical outer surface and being mounted in said passageways of said first and second members for limited reciprocal sliding movement;

a third member fixedly mounted in said housing;

a fourth member mounted for reciprocal sliding movement in said housing;

said doming die mounted on said fourth member for movement therewith;

second electromagnetic coil means for providing a magnetic field mounted in one of said third and fourth members;

second permanent magnet means for providing a magnetic field of predetermined polarity mounted in the other of said third and fourth member;

said reciprocating ram moving said can body against said doming die to apply forces on said doming die tending to move said fourth member; and energizing means for energizing said second electromagnetic coil means to produce a magnetic field having a polarity similar to said predetermined polarity to provide a repelling force to yieldingly resist the movement of said fourth member in response to said forces applied by said can body.

18. The invention as in claim 17 wherein:

said magnetic field of predetermined polarity in said other of said third and fourth members having an annular shape having a longitudinal axis coinciding with said longitudinal axis of said housing; and said magnetic field in said one of said third and fourth members of similar polarity having an annular shape having a longitudinal axis coinciding with said longitudinal axis of said housing.

19. The invention as in claim 17 wherein:

said second permanent magnet means comprises one annular permanent magnet having a longitudinal axis coinciding with said longitudinal axis of said housing; and said second electromagnetic coil means comprises one annular electromagnetic coil having a longitudinal axis coinciding with said longitudinal axis of said housing.

* * * * *